United States Patent [19]

Berzé

[11] Patent Number: 4,602,618

[45] Date of Patent: Jul. 29, 1986

[54] CONTINUOUS HIP-JOINT MOTION MACHINE

[76] Inventor: Robert W. Berzé, 2 N. 451 Mildred St., Glen Ellyn, Ill. 60137

[21] Appl. No.: 687,718

[22] Filed: Dec. 31, 1984

[51] Int. Cl.[4] ..... A61H 1/02

[52] U.S. Cl. ..... 128/25 R; 128/25 B; 128/85; 272/900

[58] Field of Search ..... 128/25 R, 25 B, 24 R, 128/24.1, 24.2, 24.3, 24.5, 84 C, 84 R, 84 B, 85; 272/900

[56] References Cited

U.S. PATENT DOCUMENTS 3,426,753 2/1969 Streckfuss ..... 128/85

3,612,042 10/1971 Fry ..... 128/25 R 3,894,534 7/1975 Graves et al. ..... 128/25 R

*Primary Examiner*—Richard J. Apley

*Assistant Examiner*—John Welsh

*Attorney, Agent, or Firm*—Leydig, Voit & Mayer, Ltd.

[57] ABSTRACT

A machine for applying passive exercise to a hip-joint following surgery. The machine includes a traction frame overlying the patient's bed, a leg cradle suspended from the traction frame, and power driven tensile elements connected to the leg cradle and a power drive imparting compound swivel movement to the leg cradle and the patient's leg about orthogonal axes centered at the socket of the hip-joint.

16 Claims, 8 Drawing Figures

CONTINUOUS HIP-JOINT MOTION MACHINE

FIELD OF THE INVENTION

The present invention relates in general to machines for applying passive exercise to the body and, more specifically, to a machine for exercising a hip-joint during convalescence following surgery or during the existence of some other condition requiring passive exercise of the hip-joint.

BACKGROUND OF THE INVENTION

The hip-joint is a massive ball and socket joint formed by the rounded head of the femur and the cup-shaped socket of the acetabulum. The articulating surfaces are covered with cartilage and held together by bands of ligaments and overlying muscle. The hip-joint is capable of several types of movement, consisting of flexion, extension, adduction, abduction, circumduction and rotation.

When the hip-joint is subjected to surgery, the complex layered structure of cartilage, ligament and muscle is necessarily cut and otherwise disturbed, leaving the joint substantially immobile to begin the healing process. Within a relatively short time after surgery, it is desirable to begin movement of the patient's leg about the hip-joint and to increase both the extent and duration of such movement progressively. Since the patient is usually unable for the first several days to stand on the leg having the hip-joint surgery, a need has arisen for a passive exercise device to restore the hip-joint and related muscles to full utility.

SUMMARY OF THE INVENTION

One object of the present invention is to provide a machine for passively exercising the hip-joint of a patient convalescing from surgery.

Another object of the invention is to provide a machine of the character set forth above which is adapted for use on a patient confined to a hospital bed during convalescence.

A further object is to provide a machine of the type set forth above adapted to exercise the hip-joint by imparting a swiveling motion to the leg, centered on the hip-joint and, as an incident thereto, flexing the knee-joint.

Still another object is to provide a machine of the foregoing type having provision for emergency stop control by the convalescing patient.

The foregoing objects are accomplished by the use of traction frame means overlying the patient's hospital bed, a leg cradle, means for suspending the leg cradle from the traction frame means, and a prime mover assembly having power driven tensile elements adapted to impart compound movement to the leg cradle and the leg of the patient thereon, such movement taking place about the socket of the hip-joint.

DETAILED DESCRIPTION OF THE INVENTION

Figure 1:
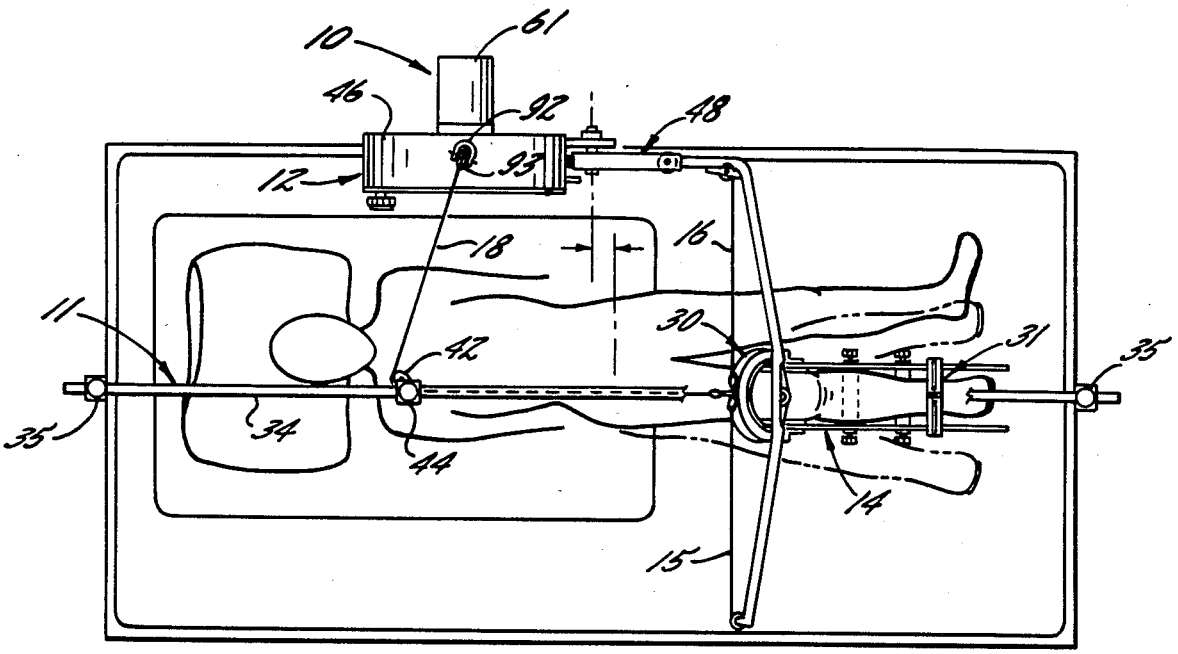
FIG. 1 is a plan view of an illustrative machine exemplifying the present invention and installed on a hospital bed for treatment of a patient convalescing from hip surgery.
Figure 2:
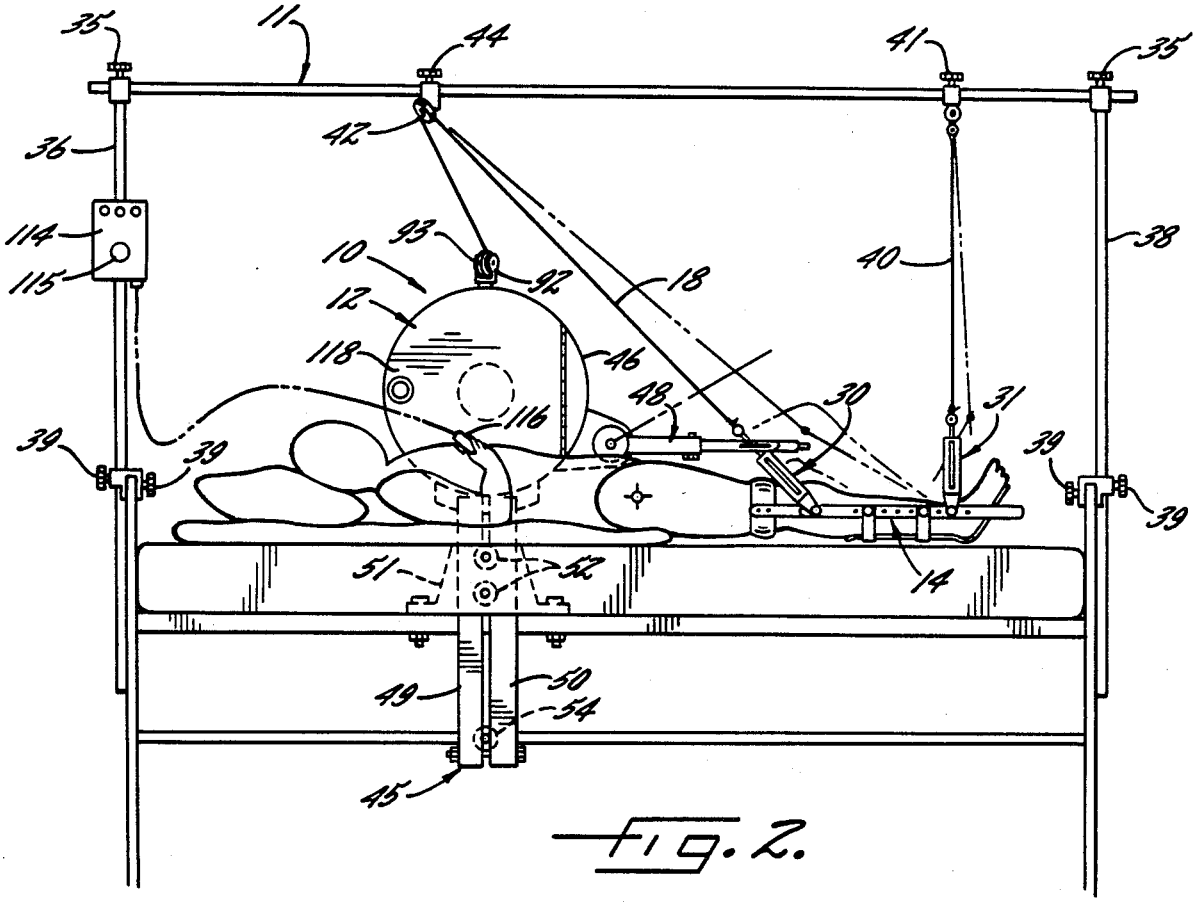
FIG. 2 is a side elevational view of the illustrative machine shown in FIG. 1.

Referring more specifically to FIGS. 1 and 2, the invention is there exemplified in an illustrative exercise machine 10 adapted for mounting on, or in close proximity to, the spring frame of a hospital bed occupied by a patient convalescing from hip surgery. The machine 10 comprises an overhead traction frame 11, a prime mover assembly 12 fixed to the spring frame and cross frame of the bed, a leg cradle 14 suspended from the traction frame 11, and tensile members 15, 16 and 18 operatively connected to the leg cradle and to the prime mover assembly. The tensile members may be made of Nylon plastic rope or similar material.

The leg cradle 14 is adapted to receive and hold the patient's leg from the bottom of the foot to a point slightly above the knee-joint (FIGS. 1–4). In the present instance, the cradle 14 comprises a pair of laterally spaced side rails 19, 20 and a pair of U-shaped cross bars 21, 22 fixed to the side rails as by bolts with knurled nuts 23. A contoured leg support plate 24 may be included in the leg cradle and rigidly fixed transversely of the cross bars 21, 22.

Figures 3, 4, 5, 6:
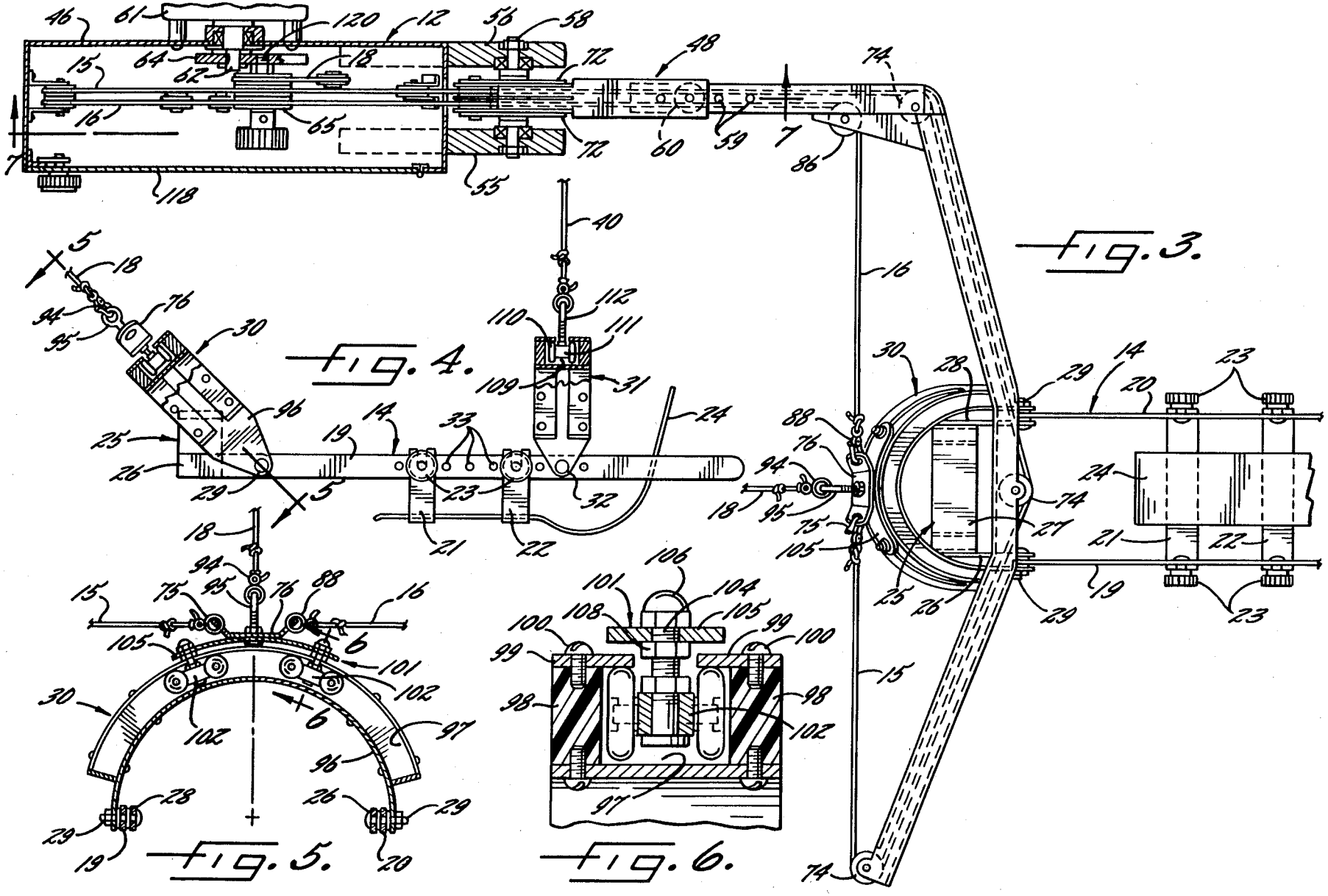
FIG. 3 is an enlarged plan view, partially in horizontal section, of the machine illustrated in FIGS. 1 and 2.
FIG. 4 is a side elevational view of the leg cradle of the machine with portions of the suspension brackets shown in section.
FIG. 5 is a sectional view through the rear suspension bracket, taken in the plane of the line 5—5 in FIG. 4.
FIG. 6 is a further enlarged, fragmentary transverse sectional view through the rear suspension bracket, taken in the plane of the line 6—6 in FIG. 5.

To accommodate the knee-joint, a relatively short moveable support 25 is pivotally attached to the side rails 19, 20 at the end of the cradle remote from the leg support 24 (FIGS. 2–4). The support 25 comprises a pair of short side rails 26, 28 secured to a bridging member 27 of inverted U-shaped configuration. The rails 26, 28 are pivotally attached to the main side rails 19, 20 as by means of bolts 29.

The leg cradle 14 includes an upper support bracket 30 and a lower support bracket 31 each of inverted U-shape (FIGS. 3–5). The upper support bracket 30, which is the larger of the two, is pivotally attached to the cradle as by means of bolts 29. The lower support bracket 31 is pivotally attached to the side rails of the leg cradle by bolts 32. To accommodate legs of different lengths, the side rails 19, 20 of the leg cradle are provided with a series of spaced apart mounting holes 33 which permit the lower supporting bracket, and also the cross bars 21, 22 and leg support plate 24 to be selectively positioned along the length of the side rails (FIGS. 2 and 4).

The leg cradle 14 is suspended in an elevated, mobile position relative to the patient's bed by means of the overhead traction frame 11. The latter comprises a horizontal bar 34 situated above the horizontal center line of the bed. The bar 34 is adjustably fixed as by clamps 35 to a pair of upright members 36, 38 adjustably secured to the headboard and footboard, respectively, by clamps 39. A flexible tensile hanger 40, which may also be made of Nylon plastic rope, is connected between the horizontal bar 34 and the lower support bracket 31 of the leg cradle. The position of the connection of the hanger 40 along the bar 34 may be varied as by means of clamp 41. Flexible tensile member 18, of variable length, is pivotally attached at one end to upper support bracket 30 of the leg cradle, trained over an angularly disposed sheave 42 mounted on the bar 34 as by means of clamp 44, and connected to the prime mover assembly 12.

In accordance with the invention, the prime mover assembly 12 is constructed and arranged to impart compound swivel movement to the leg cradle 14 and the leg of the patient thereon, such movement taking place about three orthoganal axes centered in the hip-joint socket. The assembly 12 comprises a mounting means 45, a housing 46 having motion generating means, and a floating swing arm 48 to facilitate connection of the motion generating means with the leg cradle 14 (FIGS. 1-3, 7, 8).

The mounting means 45 comprises a relatively long extension defined in this case by a pair of closely spaced metallic tubular members of rectangular cross section 49, 50. The latter are adjustably secured to a base 51 which is detachably fastened in any suitable manner to the spring frame of the patient's bed. The vertical position of the housing may be adjusted by sliding the extension up or down relative to the base 51 and then locking it in place on the base by screw clamps 52. In addition, the members 49, 50 are adjustably secured to the cross frame of the bed by another screw clamp 54.

The floating swing arm 48 is of generally L-shaped form pivotally mounted in a pair of laterally spaced brackets 55, 56 rigidly fixed to the housing 46. The arm 48 is secured to the brackets by means of a horizontally disposed cross shaft 58. The swing arm 48 is constructed of tubular material such as aluminum having a generally rectangular cross section. To permit adjustment of the swing arm longitudinally of the bed, the portion of the arm adjacent to the cross shaft 58 is formed in two telescoping sections each with a series of longitudinally spaced adjusting holes 59. The telescoping sections may be locked in a selected position of adjustment by means of a screw clamp 60 which engages a corresponding set of aligned holes 59.

Turning next to the motion generating means, it will be noted that the same includes a drive motor 61 mounted on the face of the housing 46 away from the patient's bed. The motor 61 has a drive shaft 62 extending axially into the housing 46 and a rotor bar 64 is keyed or otherwise rigidly fixed thereto. The rotor bar carries a triple groove sheave 65 journaled thereon in radially spaced relation to the motor shaft 62. The right, left and center tensile members 15, 16 and 18 are trained around the sheave 65 and are subjected to different relative motions as the rotor bar 64 rotates through 360°.

Prior to discussing the routing of the individual tensile members 15, 16 and 18, it will be helpful to clarify the meaning of the terms "right", "left" and "center" as applied to these members. Referring to FIGS. 3, 5, 7 and 8, the term "right" applies to the tensile member 15 because it tends to pull toward the patient's right hand side when drawn upon by rotation of the rotor bar 64 and triple groove sheave 65. Similarily the term "left" applies to the tensile member 16 because it tends to pull toward the patient's left hand side when drawn by the rotation of the rotor bar 64 and sheave 65. The term "center" applies to the tensile member 18 because it is connected between the tensile members 15, 16 and pulls neither to the right nor the left but upwardly at an acute angle when tensioned by rotation of the rotor bar 64 and sheave 65 against the weight of the patient's leg, the leg cradle 14 and the floating swing arm 48.

Figures 7, 8:
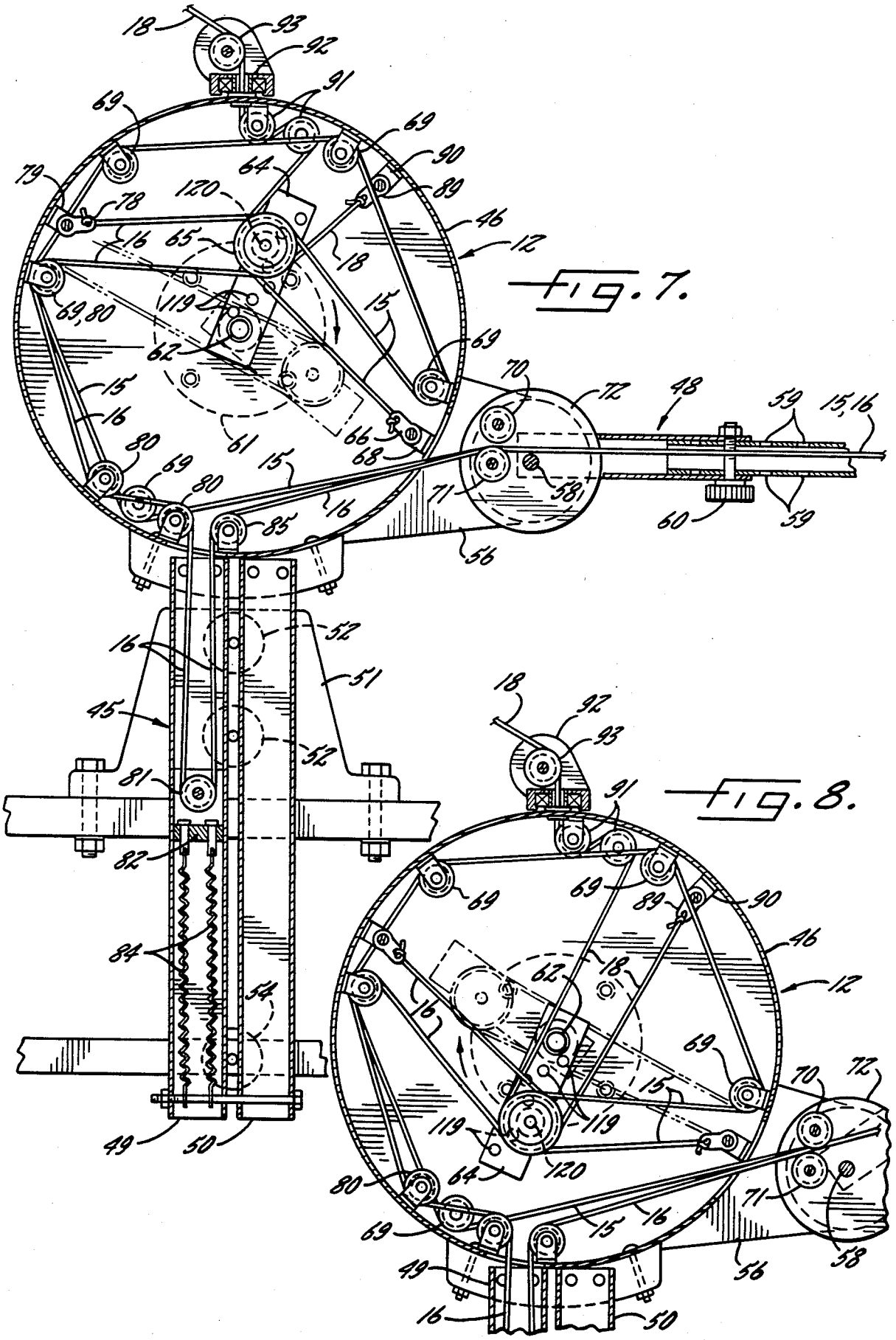
FIG. 7 is a vertical sectional view through the prime mover assembly of the machine taken in the plane of the line 7—7 in FIG. 3.
FIG. 8 is a fragmentary vertical sectional view through the prime mover assembly similar to FIG. 7 but with the rotor arm in a different position from that shown in FIG. 7. While the invention is susceptible of various modifications and alternative constructions, a certain illustrative embodiment has been shown in the drawings and will be described below in considerable detail. It should be understood, however, that there is no intention to limit the invention to the specific form disclosed, but, on the contrary, the intention is to cover all modifications, alternative constructions, and equivalents falling within the scope of the appended claims.

Referring to the right hand tensile member 15, it will be noted that this member is connected to a swivel fitting 66 mounted in a deadeye 68 fixed to the inner peripheral wall of the housing 46. As shown in FIG. 7, the right hand tensile member is trained around the triple groove sheave 65 and then around five guide sheaves 69 spaced circumferientally around the inner peripheral wall of the housing 46. From the last guide sheave 69, the member 15 exits from the housing to a pair of double guide sheaves 70, 71 housed between protective discs 72 journaled on the cross shaft 58. From the discs 72, the member 15 enters the floating swing arm 48 where it passes over three guide sheaves 74 and emerges at the right hand end of the arm 48. At that point, the member 15 turns abruptly and runs to a connecting clip 75 which engages a coupling link 76 on the upper support bracket 30.

The left hand tensile member 16 is connected to a swivel fitting 78 mounted in a deadeye 79 fixed to the inner peripheral wall of the housing 46 in diametrically opposed relation to the deadeye 68. As indicated in FIG. 7, the left hand tensile member 16 is trained around the triple groove sheave 65 and then around guide sheaves 80 spaced circumferentally on the inner peripheral wall of the housing 46. From the last guide sheave 80 the member 16 leaves the housing, enters mounting tube 49 and passes around a tensioning sheave 81 journaled on a sliding block 82 within the mounting tube 49. The block 82 and sheave 81 are urged downwardly by biasing springs 84. From the tensioning sheave 81, the member 16 re-enters the housing 46, passes over a guide sheave 85 and then exits from the housing to the double guide sheaves 70, 71 between the protective discs 72. From the discs 72, the member 16 enters the floating swing arm 48, passes around a guide sheave 86 and turns 90° to terminate at connecting clip 88. The latter engages coupling link 76 on the upper support bracket 30 of the leg cradle. By reason of this connection, the sheave 81 which tensions the member 16 also serves to tension the member 15, being coupled thereto by the link 76.

Turning next to the center tensile member 18, it will be noted that the latter is connected to a swivel fitting 89 mounted in a deadeye 90 on the inner peripheral wall of the housing 46. The member 18 passes around the triple groove sheave 65, around two guide sheaves 91 and then exits from the top of the housing into a swivel head 92 journaled thereon. A guide sheave 93 is journaled on the swivel head and moves bodily therewith (FIGS. 7, 8). The member 18 is then trained around the angularly disposed sheave 42 on the overhead bar 34 and passes downwardly at an acute angle to terminate at connecting clip 94. The latter engages an upstanding eye fitting 95 adjustably fixed to the coupling link 76 of the upper support bracket 30 (FIGS. 2–5).

In order to avoid twisting of the patient's leg and to maintain the motion of the leg cradle as smooth as possible during operation of the machine 10, each of the support brackets 30, 31 includes a swivel connection with its respective tensile member or members (FIGS. 1–6). Referring first to the upper support bracket 30, it will be noted that the latter comprises an arcuate base member 96 having its ends pivotally attached to the side rails 19, 20 of the leg cradle (FIGS. 5 and 6). An arcuate guideway 97 is formed along the convex outer surface of the base member 96 and defined by a pair of non-metallic sidewall members 98 of plastic material and a pair of laterally spaced shoulder members 99 overlying the sidewalls and the side portions of the guideway 97. These members may be secured together as by means of cap screws 100. A swivel train 101 is housed within the arcuate guideway and comprises a pair of four wheel trucks 102 each having an upstanding stud 104 projecting above the guideway and secured to a connecting bar 105 as by means of nuts 106, 108. The bar 105 is rigidly fixed to the coupling link 76 by means of the threaded eye fitting 95 which joins the center tensile member 18, via clip 94, to the coupling link 76. The foregoing parts are so constructed that the swivel train 101 is adapted to traverse the arcuate guideway 97 and accommodate its position to the varying angles between the swivel bracket and the tensile members 15, 16, 18 as the leg cradle moves through its path.

The lower support bracket 31 is constructed after the manner of the upper support bracket 30 but is somewhat smaller in size. It has an arcuate guideway 109 similar to that of the upper support bracket. The guideway 109 houses a simplified swivel train 110 consisting of a two wheel truck 111 fixed to the shank of an upstanding eye 112 to which the flexible tensile hanger 40 is connected.

As indicated earlier herein, the prime mover assembly 12 is powered by drive motor 61 which, in this instance, is a low speed AC motor rated at $\frac{1}{8}$ horsepower and capable of operating from a 115 volt AC source. The motor 61 has a detached control unit 114 which may be clamped to upright member 36 of the traction frame. The unit 114 has a speed control knob 115 which permits variation of the motor speed from 0 to 14 RPM. For a machine such as the one disclosed herein, an optimum operating speed would be on the order of one RPM. For the safety of the patient, an emergency cut-off switch 116 to stop the machine is provided on a pendant connected to the control unit 114.

Prior to operation of the machine 10, the patient should be lying in a supine position on the bed with the leg to be exercised under the connecting clips 75, 88, 94 of the floating swing arm 48. A pad of approximately 2 inch thickness should be under the patient's body. The hip-joint must be 3 to 4 inches toward the foot of the bed from a vertical plane which includes the axis of the swing arm 48. The patient's leg should be fastened on the leg cradle 14 so that the knee-joint is aligned with the main pivot axis of the upper support bracket 30 where the latter is pivotally attached to the side rails 19, 20.

To prepare the machine for operation, the access door 118 of cylindrical housing 46 should be opened and the drive motor 61 jogged to bring the rotor bar 64 to the 1:00 o'clock position shown in FIG. 7. The triple groove sheave 65 should then be located on the rotor bar in a selected radial position to provide the desired amplitude for the side-to-side and up-down motion to be imparted to the leg cradle and the patient's leg. For this purpose, the rotor bar 64 has a series of mounting holes 119 for the pivot pin 120 of the triple groove sheave 65. In the present instance, the hole closest to the axis of the motor shaft is spaced at a radius of one inch from that axis. The arrangement of the mounting holes is such that the hole 119 closest to the motor shaft moves the coupling link 76 of upper support bracket 30 4 inches laterally and 4 inches vertically for each revolution of the rotor bar 64. Each successive hole 119 situated radially outward from the first hole increases the lateral and vertical motion by another 2 inches.

Following the adjustment of the triple groove sheave on the rotor bar, the engagement of the ropes or tensile members 15, 16 and 18 with all the sheaves is checked, the housing access door is closed and secured, and the machine 10 may be placed in operation by actuating the control unit 114 and speed control knob 115.

I claim as my invention:

1. A machine for applying passive exercise to the hip-joint of a patient lying in a supine position on a hospital bed or like support, said machine comprising, in combination:

(a) a traction frame capable of overlying the support and being detachably secured thereto;

(b) a leg cradle for holding the leg connected with the hip-joint to be exercised;

(c) means for suspending said leg cradle from said traction frame;

(d) a prime mover assembly capable of being detachably secured to the support; and (e) said prime mover assembly having a plurality of tensile members connected to said leg cradle and power driven means simultaneously engaging said tensile members in order to impart continuous compound swivel movement to said leg cradle and the leg thereon, such movement taking place about three orthogonal axes centered at the socket of the hip-joint.

2. The combination set forth in claim 1, wherein said prime mover assembly further comprises:

(a) a housing;

(b) a drive motor mounted on said housing;

(c) said power driven tensile members each being connected between said housing and said leg cradle; and (d) said power driven means engaging the tensile members being driven by said motor for simultaneously changing the relative effective lengths of said tensile members and thereby imparting said continuous compound swivel movement to said leg cradle and the leg thereon.

3. The combination set forth in claim 2, wherein said drive motor has a shaft in said housing; and said motor driven means comprises a rotor bar disposed radially on said motor shaft and a drive sheave on said rotor bar simultaneously engaged with each said power driven tensile member.

4. The combination set forth in claim 3, wherein the radial position of said driven sheave on said rotor bar may be adjusted radially to vary the relative amplitude of motion imparted by each said tensile memeber to said leg cradle and the leg thereon.

5. The combination set forth in claim 4, wherein said drive sheave has three grooves permitting simultaneous engagement with all three power driven tensile members.

6. The combination set forth in claim 1, wherein said prime mover assembly further comprises:

(a) a generally cylindrical housing;
(b) an extension fixed to said housing;
(c) a base adapted to be detachably secured to the spring frame of the bed;
(d) means detachably securing said extension to said base and to the cross frame of the bed; and
(e) a floating swing arm pivotally connected to said housing through bracket means fixed to said housing, said swing arm facilitating connection of said power driven tensile members to said leg cradle.

7. A machine for applying passive exercise to the hip-joint of a patient reclining on a support and comprising, in combination:

(a) a leg cradle for supporting the patient's leg thereon;
(b) means for suspending said leg cradle so that it overlies the support;
(c) a first power driven tensile member connected to said leg cradle;
(d) a second power driven tensile member connected to said leg cradle and to said first power driven tensile member in opposing relation thereto;
(e) a third power driven tensile member connected to said leg cradle and to said first and second power driven tensile members; and
(f) power driven means simultaneously engaged with all said power driven tensile members for imparting continuous compound swivel movement to said leg cradle and the leg thereon, said movement taking place about three orthogonal axes centered at the socket of the hip joint.

8. The combination set forth in claim 7, which further comprises:

(a) a lower support bracket on said leg cradle connected to a fixed support member;
(b) an upper support bracket on said leg cradle connected to a movable support member;
(c) said first, second and third power driven tensile members being connected to said upper support bracket of said leg cradle.

9. The combination recited in claim 8, wherein said first and second power driven tensile members impart lateral components to the compound motion of said leg cradle and said third power driven tensile member imparts vertical components to the compound motion of said leg cradle.

10. The combination set forth in claim 8, wherein a resilient tensioning means is interposed between said first and second power driven tensile members and functions to tension both the first and second tensile members, and said third power driven tensile member is tensioned by said power drive means and the weight of said leg cradle and the patient's leg thereon.

11. The combination set forth in claim 8, wherein said leg cradle further comprises:

(a) a pair of laterally spaced main side rails;
(b) a pair of generally U-shaped cross bars fixed across said main side rails;
(c) a leg support plate disposed transversely of said cross bars in between said main side rails.

12. The combination set forth in claim 8, wherein said leg cradle further comprises:

(a) a first swivel train incorporated in said upper support bracket;
(b) a coupling link fixed to said first swivel train and connected to said first, second and third power driven tensile members;
(c) a second swivel train incorporated in said lower support bracket;
(d) said second swivel train being connected to said fixed support member.

13. The combination recited in claim 11, wherein said cross bars may be adjustably positioned along said side rails to accommodate legs of different lengths.

14. The combination set forth in claim 11, wherein said leg cradle includes a pair of short side rails and connecting member pivotally attached to said main side rails to engage the patient's leg above the knee, and said upper support bracket is attached to said main side rails by common pivot attachment means.

15. The combination set forth in claim 2, wherein said drive motor has a detached control unit and the latter includes a pendant with an emergency cut-off switch for use by the patient.

16. The combination recited in claim 1, wherein said prime mover assembly further comprises:

(a) a generally cylindrical housing;
(b) a drive motor mounted on said housing and having a drive shaft situated in said housing;
(c) a rotor bar drivingly fixed to said drive shaft;
(d) a drive sheave pivotally mounted on said rotor bar for orbital movement about the axis of said drive shaft;
(e) said leg cradle having upper and lower support brackets;
(f) a first tensile member connected at one end to said housing, trained around said drive sheave and connected at its opposite end to said upper support bracket;
(g) a second tensile member connected at one end to said housing, trained around said drive sheave and connected at its opposite end to said upper support bracket;
(h) and a third tensile member connected at one end to said housing, trained around said drive sheave and connected at its opposite end to said upper support bracket.

* * * * *